US010322578B2

(12) United States Patent
Kudo et al.

(10) Patent No.: US 10,322,578 B2
(45) Date of Patent: Jun. 18, 2019

(54) LIQUID EJECTION HEAD AND LIQUID EJECTION APPARATUS

(71) Applicant: CANON KABUSHIKI KAISHA, Tokyo (JP)

(72) Inventors: Tomoko Kudo, Kawasaki (JP); Takaaki Yamaguchi, Yokohama (JP); Keiji Tomizawa, Yokohama (JP); Masaki Oikawa, Inagi (JP); Yoshihiro Hamada, Yokohama (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/006,325

(22) Filed: Jun. 12, 2018

(65) Prior Publication Data

US 2018/0361734 A1 Dec. 20, 2018

(30) Foreign Application Priority Data

Jun. 20, 2017 (JP) ..... 2017-120417
May 18, 2018 (JP) ..... 2018-096200

(51) Int. Cl.
*B41J 2/14* (2006.01)
*B41J 2/045* (2006.01)

(52) U.S. Cl.
CPC ..... *B41J 2/0451* (2013.01); *B41J 2/0458* (2013.01); *B41J 2/04555* (2013.01); *B41J 2/04581* (2013.01); *B41J 2/14072* (2013.01); *B41J 2/14201* (2013.01); *B41J 2002/14491* (2013.01)

(58) Field of Classification Search
CPC .... B41J 2/0451; B41J 2/04555; B41J 2/0458; B41J 2/04581; B41J 2/14072; B41J 2/14201; B41J 2002/14491
See application file for complete search history.

(56) References Cited

U.S. PATENT DOCUMENTS

| | | | |
|---|---|---|---|
| 6,773,096 | B2 | 8/2004 | Mochizuki et al. |
| 6,945,622 | B2 | 9/2005 | Sakurai |
| 7,172,268 | B2 | 2/2007 | Oikawa |
| 7,216,960 | B2 | 5/2007 | Imanaka et al. |
| 7,216,961 | B2 | 5/2007 | Oikawa et al. |
| 7,344,218 | B2 | 3/2008 | Imanaka et al. |
| 7,354,125 | B2 | 4/2008 | Hirayama et al. |
| 7,594,713 | B2 | 9/2009 | Silverbrook |
| 7,815,272 | B2 | 10/2010 | Kasai et al. |
| 7,841,678 | B2 | 11/2010 | Imanaka et al. |
| 7,896,474 | B2 | 3/2011 | Kasai et al. |
| 7,896,475 | B2 | 3/2011 | Omata et al. |
| 7,918,538 | B2 | 4/2011 | Sakurai |
| 8,147,039 | B2 | 4/2012 | Kurokawa et al. |

(Continued)

*Primary Examiner* — Thinh H Nguyen
(74) *Attorney, Agent, or Firm* — Venable LLP

(57) ABSTRACT

A liquid ejection head includes a substrate including an electrically insulating film, an energy generating element provided on the substrate and configured to generate energy used to eject a liquid, a flow path formed through the substrate and communicating with an ejection port configured to eject a liquid, and a wiring layer formed in the electrically insulating film of the substrate, used to drive the energy generating element, provided apart from a wall defining the flow path, and provided to surround the flow path in a plan view of the substrate.

20 Claims, 9 Drawing Sheets

(56) References Cited

U.S. PATENT DOCUMENTS

| | | | | |
|---|---|---|---|---|
| 8,272,708 | B2 * | 9/2012 | Silverbrook | B41J 2/1404 347/14 |
| 8,439,483 | B2 | 5/2013 | Kihara et al. | |
| 8,523,325 | B2 | 9/2013 | Sakurai et al. | |
| 8,529,003 | B2 | 9/2013 | Sakurai | |
| 8,746,847 | B2 * | 6/2014 | Kishikawa | B41J 2/1404 347/50 |
| 9,597,870 | B2 | 3/2017 | Sakurai et al. | |
| 9,731,503 | B2 | 8/2017 | Kodoi et al. | |

* cited by examiner

LIQUID EJECTION HEAD AND LIQUID EJECTION APPARATUS

BACKGROUND OF THE INVENTION

Field of the Invention

The present invention relates to a liquid ejection head and a liquid ejection apparatus.

Description of the Related Art

As a liquid ejection system for liquid ejection heads, a thermal system using a heating element has been known. In the system, the heating element generates thermal energy that generates bubbles in a liquid, and the bubbles are used to eject the liquid. The liquid ejection head of the thermal system includes a substrate having heating elements and a flow path forming member joined with the substrate and having ejection ports for ejecting a liquid. Between the substrate and the flow path forming member, flow paths communicating with the ejection ports are formed, and in the substrate, supply paths passing through the substrate and communicating with the flow paths are formed. The heating elements are provided at positions corresponding to the ejection ports of the substrate.

In a thermal system liquid ejection head that ejects an ink as the liquid, a protective film or an electrically insulating film is typically provided on an area to come into contact with the ink, for protection and electric insulation from the ink. Such a protective film or an electrically insulating film, however, may dissolve in an ink. Accordingly, a wiring, a circuit, or the like protected by such a protective film or an electrically insulating film may be exposed to come into contact with an ink, and when a leak current flows through the ink, the liquid ejection head may malfunction. Against the dissolution of a protective film or an electrically insulating film by an ink, a measure to suppress the malfunction of a liquid ejection head is also required.

U.S. Pat. No. 7,594,713 discloses a structure in which a plurality of ring-shaped wiring layers are formed to surround supply paths in a substrate (interlayer electrically insulating film). The plurality of wiring layers are stacked in the thickness direction of the substrate and are electrically connected to each other through interlayer vias and to the substrate. In this structure, even when the substrate (interlayer electrically insulating film) is dissolved, then a part or all of the plurality of wiring layers are exposed to supply paths to come into contact with an ink, and a leak path to the ink is formed, so that a current flowing to the wiring layer escapes to the substrate (ground potential). As a result, a leak current can be prevented from flowing to other wirings or circuits, and adverse effects including malfunction of a liquid ejection head can be suppressed.

However, in the above structure, the plurality of wiring layers are electrically independent of wirings for driving energy generating elements such as heaters, and typically, no electric potential is applied to the wiring layers. When an electrically insulating film is dissolved in such conditions, only a little current flows from an ink through a wiring layer to a substrate and thus is difficult to detect. It is accordingly difficult to detect the dissolution by an ink. Hence, the dissolution may develop through interlayer vias to dissolve the wiring layer itself, and in the case, a liquid ejection head may malfunction.

In such circumstances, the present invention is intended to provide a liquid ejection head and a liquid ejection apparatus that enable the detection of dissolution of a substrate by a liquid to prevent malfunction.

SUMMARY OF THE INVENTION

In order to achieve the object, a liquid ejection head of the present invention includes a substrate including an electrically insulating film, an energy generating element provided on the substrate and configured to generate energy used to eject a liquid, a flow path formed through the substrate and communicating with an ejection port configured to eject a liquid, and a wiring layer formed in the electrically insulating film of the substrate and used to drive the energy generating element, the wiring layer being provided apart from a wall defining the flow path and provided to surround the flow path in a plan view of the substrate.

A liquid ejection apparatus of the present invention includes the above-mentioned liquid ejection head and a leak detection mechanism electrically connected to the wiring layer and configured to detect a leak current flowing from the wiring layer.

In such a liquid ejection head or a liquid ejection apparatus, when an electrically insulating film is dissolved by a liquid through a flow path, and accordingly a wiring layer is exposed to the flow path and comes into contact with a liquid, a leak current flows from the wiring layer (at a high electric potential) to the liquid (at a low electric potential). The leak current can be easily detected by a leak detection mechanism connected to the wiring layer. With this structure, on detection of a leak current, a liquid ejection operation can be stopped, or a liquid ejection head can be replaced. Accordingly, the liquid ejection head can be prevented from malfunctioning.

According to the present invention, dissolution of a substrate by a liquid can be detected, and this can prevent a liquid ejection head and a liquid ejection apparatus from malfunctioning.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will now be described with reference to drawings. In the present specification, a liquid ejection head that ejects an ink to record images on recording media will be described as an example of the liquid ejection head of the present invention, which is also applicable to a liquid ejection head that ejects other liquids. A thermal system using a heating element as the recording element for generating bubbles to eject a liquid is adopted, but the present invention is also applicable to recording element substrates using a piezoelectric system or various other liquid ejection systems. The present invention is also usable as recording element substrates in industrial recording apparatuses for biochip preparation, electronic circuit printing, and resist coating to form circuit patterns of semiconductor wafers, for example.

First Embodiment

Figure 1:
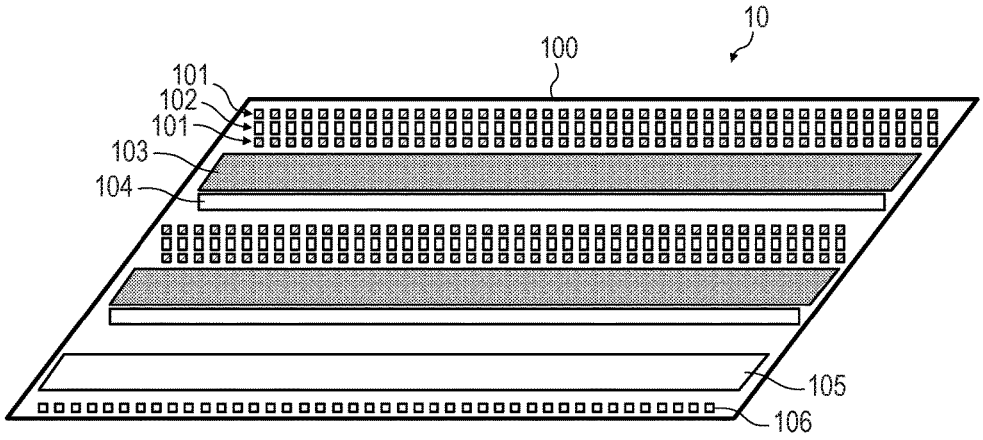
FIG. 1 is a plan view showing a structure example of a liquid ejection head pertaining to a first embodiment.

FIG. 1 is a plan view showing a structure example of a liquid ejection head pertaining to a first embodiment of the present invention. A liquid ejection head 10 includes a substrate 100 containing a silicon base material, and the substrate 100 is joined with a flow path forming member (not shown) having a plurality of ejection ports for ejecting a liquid. Between the substrate 100 and the flow path forming member, a plurality of flow paths communicating with the plurality of ejection ports are formed, and in the substrate 100, a plurality of supply paths passing through the substrate 100 and communicating with the plurality of flow paths are formed. On the surface of the substrate 100, supply port rows 101 including openings (supply ports) of the plurality of supply paths are formed. Between two supply port rows 101, a heater row 102 in which a plurality of heating elements (heaters) are arranged as energy generating elements for generating energy used for ejecting a liquid is formed. Adjacent to two supply port rows 101 and a heater row 102, a driving element unit 103 and a heater selection circuit unit 104 are provided. The driving element unit 103 and the heater selection circuit unit 104 include a plurality of driving elements and a plurality of heater selection circuits, respectively, corresponding to the plurality of heaters. At an edge of the substrate 100, a pad row 106 for electrical connection of a recording data supply circuit 105 to the outside is provided. The heater selection circuit unit 104 outputs driving signals based on recording data from the recording data supply circuit 105, and the driving element unit 103 drives corresponding heaters based on the recording data from the recording data supply circuit 105 and the driving signals from the heater selection circuit unit 104. Accordingly, an ink is ejected from corresponding ejection ports. The outer shape of the substrate 100 is not limited to a parallelogram shown in the figure and may be a rectangular shape or another shape.

The liquid ejection head 10 may have an ink circulation structure in which one of the two supply port rows 101 provided on both sides of a heater row 102 is served as a recovery port row for recovering a liquid, and an ink supplied from a supply port to a heater is recovered from a recovery port.

Figure 2:
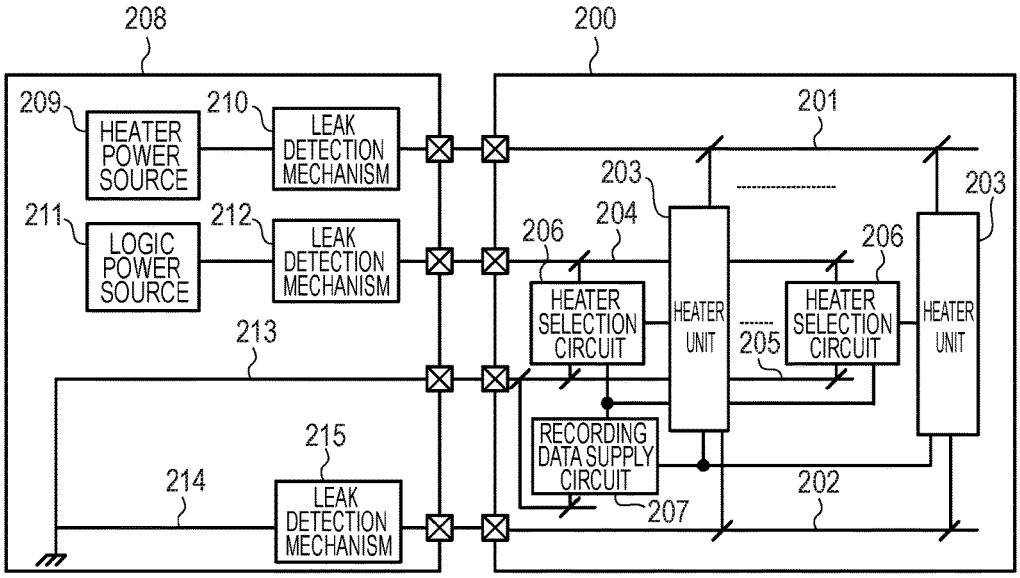
FIG. 2 is a block diagram showing a circuit structure example of a liquid ejection apparatus pertaining to the first embodiment.

FIG. 2 is a block diagram showing a circuit structure example of a liquid ejection apparatus including the liquid ejection head in the present embodiment.

A liquid ejection head 200 includes a plurality of heater units 203 each including a heater and a driving element for driving the heater, a plurality of heater selection circuits 206 corresponding to the plurality of heater units 203, and a recording data supply circuit 207. The plurality of heater units 203 are connected to a heater power source wiring 201 for supplying a power source potential to heaters and are connected to a heater ground wiring 202 for supplying a reference potential to heaters. The plurality of heater selection circuits 206 are connected to a logic power source wiring 204 for supplying a power source potential to a logic circuit including the heater selection circuits 206 and are connected to a logic ground wiring 205 for supplying a reference potential to the logic circuit. The recording data supply circuit 207 is connected to the plurality of heater units 203 and the plurality of heater selection circuits 206.

In a main body 208 of the liquid ejection apparatus, the heater power source wiring 201 is connected through a leak detection mechanism 210 to a heater power source 209, and the logic power source wiring 204 is connected through a leak detection mechanism 212 to a logic power source 211. In the main body 208, the heater ground wiring 202 is connected through a leak detection mechanism 215 to a ground wiring 214, and the ground wiring 214 is connected to a ground wiring 213 that is connected to a ground power source. The logic ground wiring 205 is connected to the ground wiring 213. The example illustrated in the figure includes three types of power sources, but the number of power sources is not limited to three, and the leak detection mechanisms are also provided to correspond to all the power sources, but may be provided for only particular power sources.

Figure 3:
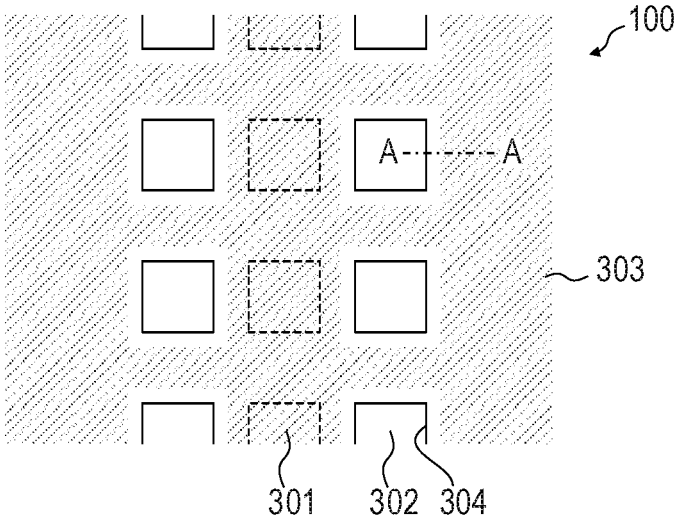
FIG. 3 is a plan view showing a wiring layout of a substrate pertaining to the first embodiment.

FIG. 3 is a plan view showing a layout example of a heater power source wiring or a heater ground wiring formed in the substrate of the embodiment.

A substrate 100 includes a plurality of heaters 301, a plurality of supply paths 302, and a conductive layer 303 (wiring layer) as the heater power source wiring or the heater ground wiring. The substrate 100, as described later, includes a silicon base material and an electrically insulating film formed thereon. The conductive layer 303 is what is called a solid layer provided in the electrically insulating film, is provided a certain distance apart from wall surfaces 304 defining the respective supply paths 302, and is provided to surround the supply paths 302 in a plan view of the substrate 100. This arrangement can increase the wiring area of the conductive layer 303 to suppress the wiring resistance in consideration of recent trends of an increase in substrate area, a higher density of heaters 301, and an increase in heater driving current associated with a higher electric potential of a heater power source. As a result, adverse effects due to a variation in ejection energy can be suppressed, and satisfactory image formation can be achieved. On the wall surfaces 304 of the supply paths 302, a protective film may be formed.

In the above arrangement of the conductive layer 303, when the protective film or the electrically insulating film is dissolved by an ink through a supply path 302, and the wall surface 304 of the supply path 302 goes back to expose the conductive layer 303 to the supply path 302, the heater power source wiring or the heater ground wiring comes into contact with the ink. For example, when the heater power source wiring comes into contact with an ink, a leak path is formed through the ink from the heater power source wiring to the silicon base material, other wirings, or the like, and a leak current flows. When the protective film on the heater is connected, for example, to a ground potential or any electric potential, a leak path is also formed from an ink to the protective film.

Meanwhile, the heater ground wiring, through which a large current for driving heaters flows, typically has a higher potential than the ground potential of the silicon base material. Hence, when the heater ground wiring comes into contact with an ink, a leak current may flow through the ink from the heater ground wiring to the silicon base material (ground potential).

In the present embodiment, the power source leak detection mechanisms are provided for the respective power sources as described above, and even when such a leak current is generated, the power source leak detection mechanisms can be used to detect the generation of a leak current based on a change in current or voltage. Accordingly, the dissolution of a protective film or an electrically insulating film by an ink can be detected as a power source leak. Hence, on the detection of a power source leak, a liquid ejection operation can be stopped, or a liquid ejection head can be replaced. As a result, the liquid ejection head can be prevented from malfunctioning. In particular, a heater power source wiring is a wiring for supplying a power source potential to a heater, and thus a higher electric potential (for example, about 32 V) is applied thereto than other wiring layers including a heater ground wiring, a logic power source wiring, and a logic ground wiring. Hence, a large leak current is generated when the heater power source wiring comes into contact with an ink, and a leak can be detected with high sensitivity. On this account, the structure in which a power source leak detection mechanism is provided for a heater power source wiring is more preferred. When an ink is in contact with a silicon base material to be connected to a ground potential, and, for example, a leak path from the heater power source wiring is formed, the leak current flows to the silicon base material, and thus the effect thereof can be minimized.

In order to detect dissolution by an ink through supply paths 302, for example, linear wirings could be provided around the supply paths 302 to detect a change in resistance value, wire breaking, or a leak current. However, with such a structure, ends of wirings cannot be connected to each other for ensuring a current pathway, and thus no wiring area is unavoidable around the supply paths 302. When dissolution by an ink occurs in the area, the dissolution cannot be detected. In contrast, in the present embodiment, the conductive layer 303 is provided to surround the entire circumference of each supply path 302 in a plan view of the substrate 100, and thus the dissolution by an ink can be more reliably detected.

Figure 4A:
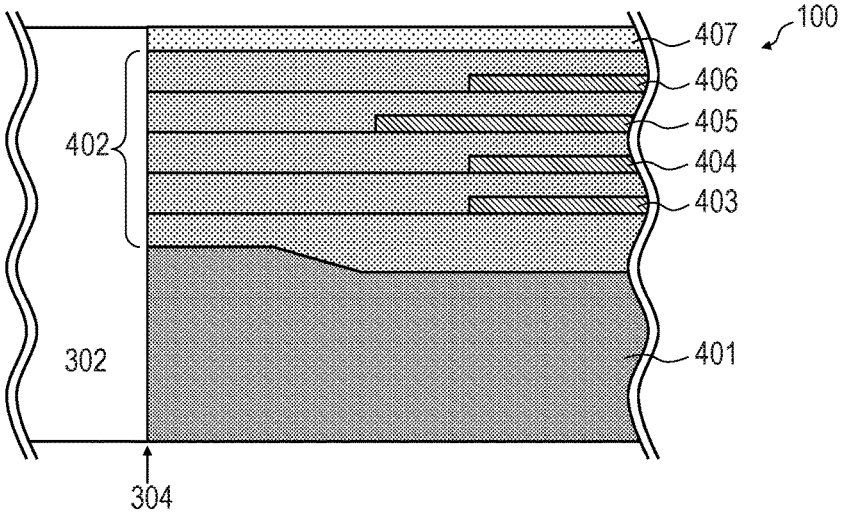
FIG. 4A and FIG. 4B are sectional views showing structure examples of the substrate pertaining to the first embodiment.
Figure 4B:
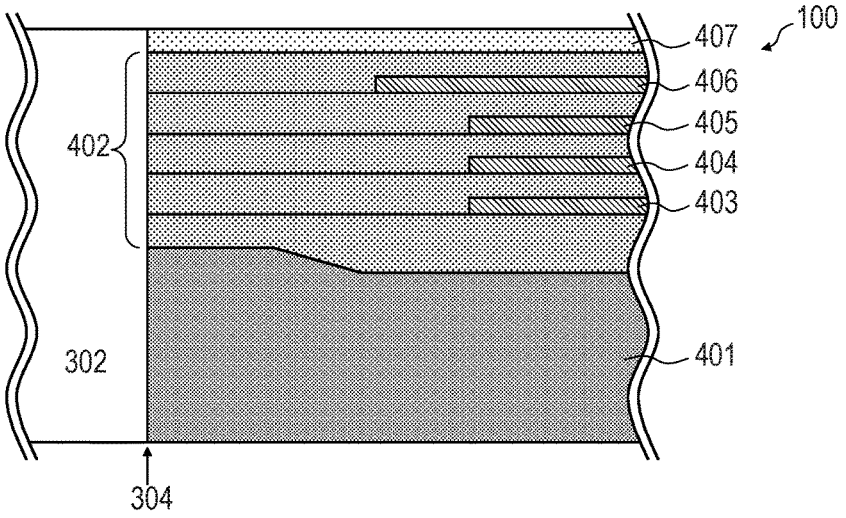

FIG. 4A and FIG. 4B are schematic sectional views taken along the line A-A' in FIG. 3 and show structure examples of the substrate of the embodiment. FIG. 4A corresponds to the case in which a heater power source wiring is provided around the supply paths 302, and FIG. 4B corresponds to the case in which a heater ground wiring is provided.

As shown in FIG. 4A and FIG. 4B, a substrate 100 includes a silicon base material 401, an interlayer electrically insulating film 402, and four wiring layers 403 to 406. The interlayer electrically insulating film 402 is formed on the silicon base material 401, and the four wiring layers 403 to 406 are formed apart from each other in the thickness direction of the substrate 100 while interposing the interlayer electrically insulating film 402. On the interlayer electrically insulating film 402, a protective film 407 is formed.

A first wiring layer 403 is a wiring layer containing at least one of a logic signal wiring for transmitting logic signals to a logic circuit such as a heater selection circuit and a recording data supply circuit, a logic power source wiring, and a logic ground wiring. A second wiring layer 404 is, as with the first wiring layer 403, a wiring layer containing at least one of the logic signal wiring, the logic power source wiring, and the logic ground wiring. The first wiring layer 403 and the second wiring layer 404 may be layers having the same function. For example, each layer may contain the logic signal wiring, the logic power source wiring, and the logic ground wiring. Alternatively, the first wiring layer 403 and the second wiring layer 404 may be layers having different functions. For example, the first wiring layer 403 may contain the logic signal wiring, and the second wiring layer 404 may contain the logic power source wiring and the logic ground wiring. A third wiring layer 405 is a solid wiring as a heater power source wiring, and a fourth wiring layer 406 is a solid wiring as a heater ground wiring. Here, the solid wiring is a wiring provided so as to be electrically connected commonly to a plurality of heater rows 102, and ensures a large wiring area over the face of the substrate 100 to suppress the wiring resistance thereof.

In the structure examples shown in FIG. 4A and FIG. 4B, the third wiring layer 405 or the fourth wiring layer 406 is used to detect a leak current, and thus the first wiring layer 403 or the second wiring layer 404 is not necessarily provided to surround the supply paths 302. The first wiring layer 403 and the second wiring layer 404 are provided to route a plurality of wirings having different functions, such as a logic signal wiring, a logic power source wiring, and a logic ground wiring. Hence, neither the first wiring layer 403 nor the second wiring layer 404 is typically a solid wiring, and the wiring resistance thereof is higher than that of the third wiring layer 405 or the fourth wiring layer 406.

In the structure example shown in FIG. 4A, of the four wiring layers 403 to 406, the third wiring layer 405 as the heater power source wiring is provided most closely to the wall surface 304 of the supply path 302. Hence, dissolution of the interlayer electrically insulating film 402 by an ink through the supply path 302 can be detected as a leak of the heater power source. In the structure example, the heater power source is a high potential power source (for example, about 32 V), thus a current change by a leak current is readily captured, and the occurrence of a power source leak can be detected with high sensitivity. In other words, from the viewpoint of the detection sensitivity of the occurrence of a power source leak, such a structure that the third wiring layer 405 as the heater power source wiring is provided more closely to the wall surface 304 of the supply path 302 than other wiring layers is preferred.

In the structure example shown in FIG. 4B, of the four wiring layers 403 to 406, the fourth wiring layer 406 as the heater ground wiring is provided most closely to the wall surface 304 of the supply path 302. Hence, when the heater ground wiring has a higher electric potential (reference potential) than the ground potential, dissolution of the interlayer electrically insulating film 402 by an ink through the supply path 302 can be detected as a leak of the ground power source. In the structure example, a leak current flows from the heater ground wiring, and thus the effect by the leak current can be minimized.

Any of the four wiring layers 403 to 406 may contain any wiring, and the wiring combination is not limited to the above examples. For example, any of the four wiring layers 403 to 406 may include a heater power source wiring. The number of wiring layers is not limited to 4 and may be 5 or more. Also in such a case, any layer contains any wiring.

Second Embodiment

Figure 5A:
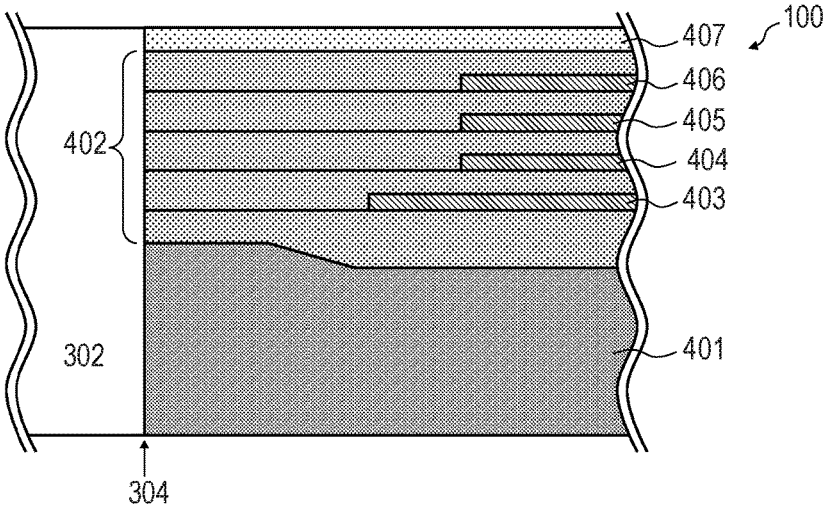
FIG. 5A and FIG. 5B are sectional views showing structure examples of a substrate pertaining to a second embodiment.
Figure 5B:
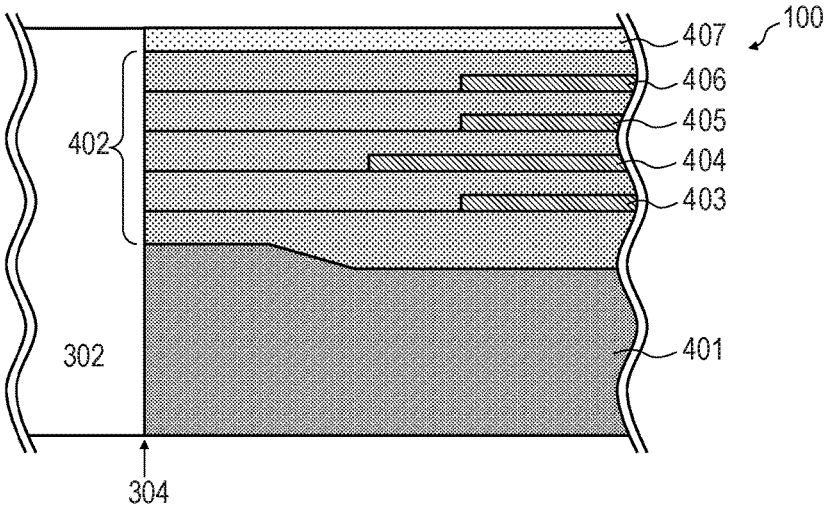

FIG. 5A and FIG. 5B are views corresponding to a schematic sectional view taken along the line A-A' in FIG. 3 and showing structure examples of a substrate pertaining to a second embodiment of the present invention.

The wiring provided around supply paths 302 for detecting dissolution of an interlayer electrically insulating film 402 by an ink is not limited to the heater power source wiring or the heater ground wiring, and may be the logic power source wiring. In other words, dissolution of an interlayer electrically insulating film 402 by an ink through supply paths 302 can be detected as a leak of the logic power source. The present embodiment differs from the first embodiment in that, of four wiring layers 403 to 406, the first wiring layer 403 or the second wiring layer 404 containing the logic power source wiring is provided most closely to the wall surface 304 of the supply path 302. The other structure is the same as the first embodiment, and only the difference from the first embodiment will next be described.

In the structure example shown in FIG. 5A, a first wiring layer 403 is provided most closely to the wall surface 304 of a supply path 302. The first wiring layer 403 is, as described above, a wiring layer containing at least one of a logic signal wiring, a logic power source wiring, and a logic ground wiring but, in the example, contains at least the logic power source wiring. In the first wiring layer 403, the wiring layer provided most closely to the wall surface 304 of the supply path 302 is the logic power source wiring. Hence, when dissolution of an interlayer electrically insulating film 402 by an ink through the supply path 302 develops, and the ink comes into contact with the first wiring layer 403, the dissolution of an interlayer electrically insulating film 402 by an ink through the supply path 302 can be detected as a leak of the logic power source by the same principle as the case of the heater power source. In this case, the logic power source has a lower electric potential (for example, about 3.3 V) than the heater power source, thus the leak current from the logic power source is relatively small, and the effect by the leak current can be minimized. In addition, the leak detection of the logic power source has an advantage in terms of easy observation during image formation as compared with the case of the heater power source through which a current flows during image formation.

In the structure example shown in FIG. 5B, a second wiring layer 404 is provided most closely to the wall surface 304 of a supply path 302, but as with the structure example shown in FIG. 5A, the second wiring layer 404 contains at least the logic power source wiring. In the second wiring layer 404, the wiring layer provided most closely to the wall surface 304 of the supply path 302 is the logic power source wiring. Hence, as with the structure example shown in FIG. 5A, the dissolution of an interlayer electrically insulating film 402 by an ink through the supply path 302 can be detected as a leak of the logic power source.

Third Embodiment

FIG. 6A, FIG. 6B, FIG. 7A, and FIG. 7B are views corresponding to a schematic sectional view taken along the line A-A' in FIG. 3 and showing structure examples of a substrate pertaining to a third embodiment of the present invention.

The present embodiment differs from the first embodiment in that, of four wiring layers 403 to 406, two wiring layers are provided more closely to the wall surface 304 of a supply path 302 than the other wiring layers. The other structure is the same as the first and second embodiments, and only the difference from the first and second embodiments will next be described.

Figure 6A:
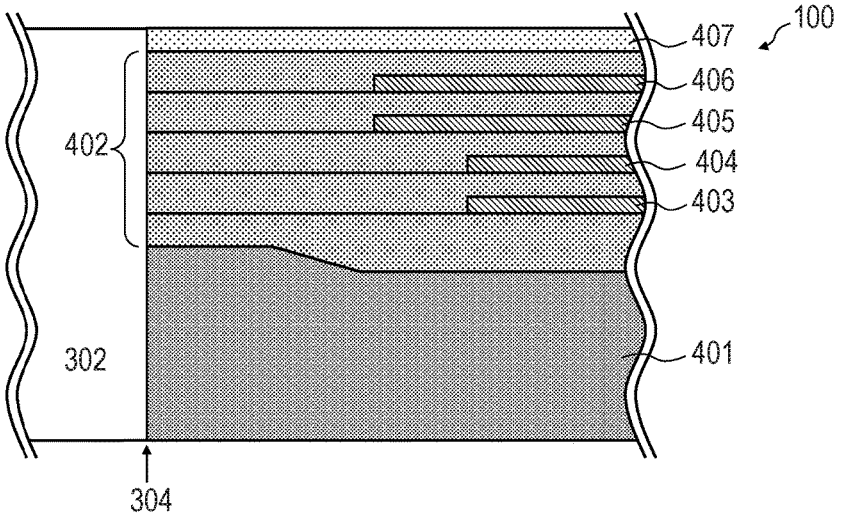
FIG. 6A and FIG. 6B are sectional views showing structure examples of a substrate pertaining to a third embodiment.

In the structure example shown in FIG. 6A, a third wiring layer 405 as the heater power source wiring and a fourth wiring layer 406 as the heater ground wiring are provided closely to the wall surface 304 of a supply path 302. The third wiring layer 405 and the fourth wiring layer 406 are provided to surround the supply paths 302 in a plan view of the substrate 100. With this structure, when dissolution of an interlayer electrically insulating film 402 by an ink through the supply path 302 develops, one or both of the third wiring layer 405 and the fourth wiring layer 406 first come into contact with the ink. Hence, the dissolution of the interlayer electrically insulating film 402 by an ink can be detected by one or both of a leak of the heater power source and a leak of the ground power source, and this can improve the detection reliability of dissolution by an ink. When both the third wiring layer 405 and the fourth wiring layer 406 come into contact with an ink, a leak current flows from the third wiring layer 405 as the heater power source wiring at a high potential to the fourth wiring layer 406 as the heater ground wiring, and the current flows from the heater ground wiring to a silicon base material 401. As described above, in the structure example in FIG. 6A, a leak current can flow from the third wiring layer 405 to the fourth wiring layer 406 between which the potential difference is large, unlike the structure example in FIG. 4A in which only the heater power source wiring is close to the wall surface 304 of the supply port 302, and thus a leak current can be detected with higher sensitivity. In addition, a leak current flows from the fourth wiring layer 406 to the silicon base material 401, and thus heat generation by the leak current or effects on other circuits can be suppressed. In the example, the fourth wiring layer 406 as the heater ground wiring is formed as a solid wiring as described above and has a lower wiring resistance than the first wiring layer 403 or the second wiring layer 404 as wirings connected to a logic circuit. Hence, from the viewpoint of suppression of heat generation by a leak current or effects on other circuits, such a structure that the third wiring layer 405 as the heater power source wiring and the fourth wiring layer 406 as the heater ground wiring are provided closely to the wall surface 304 of the supply port 302 is preferred. In the structure, both the third wiring layer 405 and the fourth wiring layer 406 are close to the wall surface 304 of the supply path 302 and have large areas, and thus the wiring resistances thereof can be suppressed. Hence, the structure can also further suppress the effect on image formation by a variation in ejection energy.

In the structure example shown in FIG. 6A, the first wiring layer 403 or the second wiring layer 404 is not necessarily provided to surround the supply paths 302.

Figure 6B:
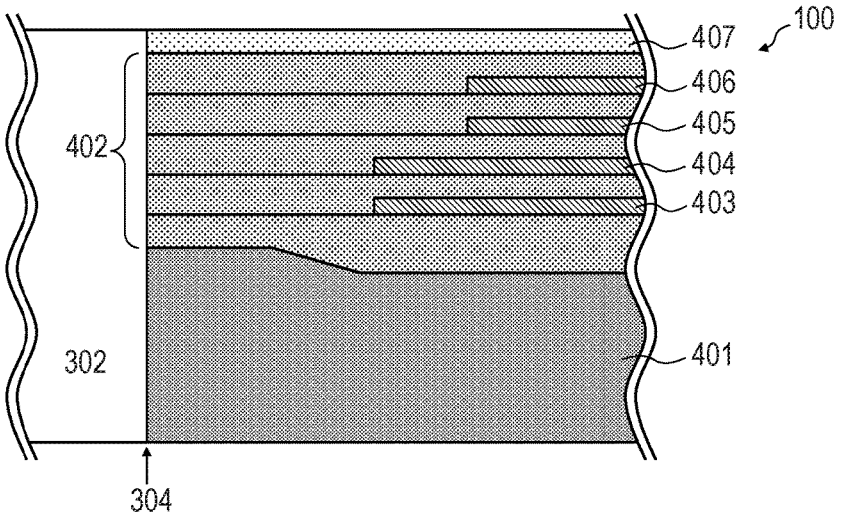

In the structure example shown in FIG. 6B, a first wiring layer 403 containing at least the logic power source wiring and a second wiring layer 404 containing at least the logic power source wiring are provided closely to the wall surface 304 of a supply path 302. Also in this case, when one of the first wiring layer 403 and the second wiring layer 404 comes into contact with an ink, the dissolution of an interlayer electrically insulating film 402 by an ink through the supply path 302 can be detected as a leak of the logic power source, and this can improve the detection reliability of dissolution by an ink. In the structure example shown in FIG. 6B, one of the first wiring layer 403 and the second wiring layer 404 may contain at least the logic power source wiring, and the other may contain at least the logic ground wiring. Also in this case, when both the first wiring layer 403 and the second wiring layer 404 come into contact with an ink, a leak current flows between the first wiring layer 403 and the second wiring layer 404 through the ink, and the dissolution of an interlayer electrically insulating film 402 by an ink can be detected.

Figure 7A:
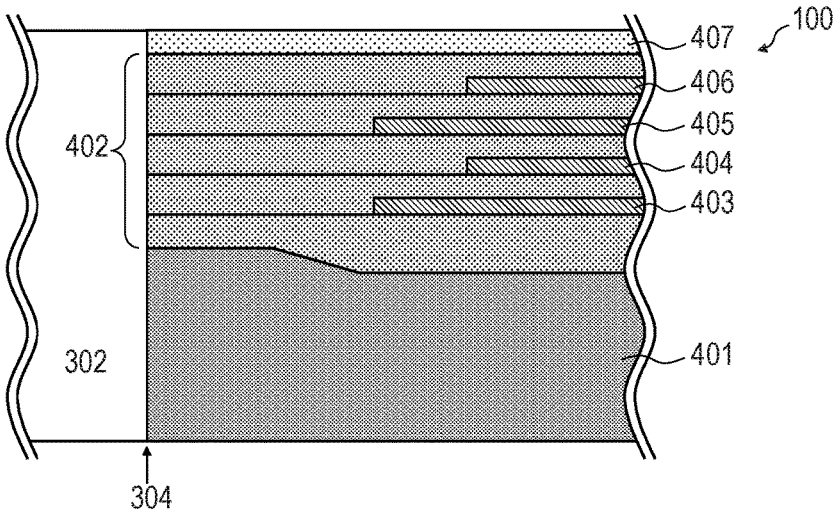
FIG. 7A and FIG. 7B are sectional views showing structure examples of a substrate pertaining to the third embodiment.

In the structure example shown in FIG. 7A, a third wiring layer 405 and a first wiring layer 403 are provided closely to the wall surface 304 of a supply path 302, and the first wiring layer 403 contains at least the logic ground wiring. In the structure example shown in FIG. 7B, a third wiring layer 405 and a second wiring layer 404 are provided closely to the wall surface 304 of a supply path 302, and as with the structure example shown in FIG. 7A, the second wiring layer 404 contains at least the logic ground wiring. Hence, in the structure examples shown in FIG. 7A and FIG. 7B, when both of two wiring layers come into contact with an ink, a leak current flows from the heater power source wiring through the ink to the logic ground wiring, and thus the effect thereof can be suppressed.

Figure 7B:
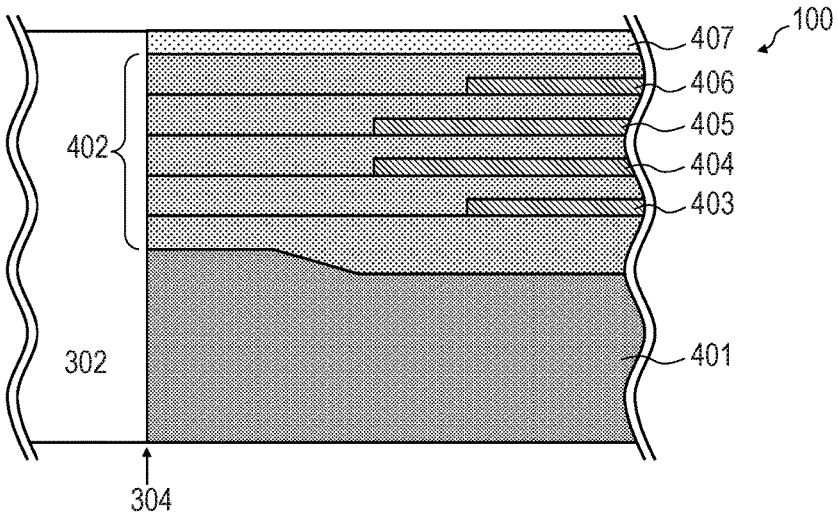

In the structure examples shown in FIG. 7A and FIG. 7B, the fourth wiring layer 406 (heater ground wiring) may be provided closely to the wall surface 304 of the supply path 302 in place of the third wiring layer 405 (heater power source wiring). Also in this case, when both of two wiring layers come into contact with an ink, a leak path through the ink to the logic ground wiring can be formed, and thus the effect by a leak current can be suppressed.

In such a structure as in the embodiment in which two wiring layers are provided more closely to the wall surface 304 of the supply path 302 than the other wiring layers, one wiring layer of the two wiring layers is a wiring for supplying a power source potential, such as a heater power source wiring and a logic power source wiring. The other wiring layer of the two wiring layers is a wiring for supplying a reference potential, such as a heater ground wiring and a logic ground wiring, and is connected to the silicon base material 401. One wiring layer has a higher electric potential than the other wiring layer, thus a leak current flows from a ground wiring to the silicon base material 401, and the effect by a leak current can be suppressed.

The above embodiments have described, as examples, use of a wiring (a power source wiring, a ground wiring, or a logic power source wiring) used for driving heating elements (heaters) in order to detect dissolution of a protective film or an electrically insulating film by an ink. When such a wiring is used to detect a leak current, the leak current can be detected without a special wiring, a pad, or the like for detecting a leak current. In order to detect a leak with high sensitivity, a wiring to which a potential of 3.0 V or more is applied, such as a heater power source wiring and a logic power source wiring, is preferably used to detect a leak current. In order to detect a leak with higher sensitivity, a wiring to which a potential of 20 V or more is applied, such as a heater power source wiring, is more preferably used to detect a leak current.

Such a structure that the conductive layer connected to a leak detection mechanism surrounds supply paths 302 in a plan view of a substrate 100 has been described, but when recovery paths for recovering an ink are provided in addition to the supply paths 302, a conductive layer may be provided to surround the recovery paths. In other words, a conductive layer can be provided to surround flow paths penetrating a substrate 100, such as supply paths 302 and recovery paths.

(Ink Jet Recording Apparatus)

Figure 8:
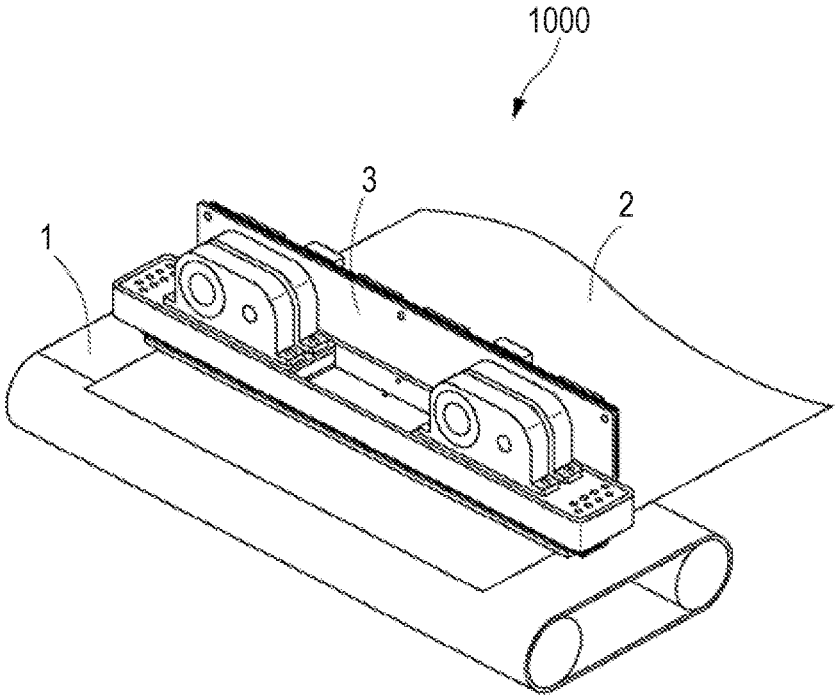
FIG. 8 is a schematic structure view showing an ink jet recording apparatus.

As a liquid ejection apparatus to which the present embodiment is applicable, an ink jet recording apparatus 1000 (hereinafter also called "recording apparatus") that ejects an ink for recording will be described with reference to FIG. 8 showing the schematic diagram thereof. The recording apparatus 1000 is a line recording apparatus that includes a conveyer 1 configured to convey a recording medium 2 and a line liquid ejection head unit 3 provided substantially orthogonal to the conveyance direction of the recording medium 2 and performs continuous recording in a single pass manner while a plurality of recording media 2 are conveyed continuously or intermittently. The recording medium 2 is not limited to a cut paper but may be a continuous roll paper. The liquid ejection head 3 enables full color printing using four color inks of cyan/magenta/yellow/black inks (CMYK inks). The liquid ejection head 3 is electrically connected to a controller of the recording apparatus 1000 for transmitting electric power or ejection control signals to the liquid ejection head 3.

(Liquid Ejection Head Unit)

Figure 9:
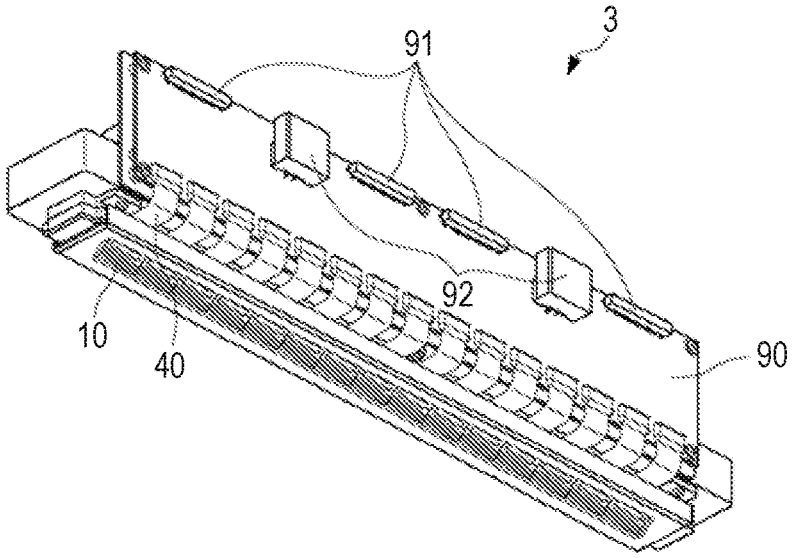
FIG. 9 is a perspective view showing an ink jet recording head.

FIG. 9 is a perspective view of a liquid ejection head unit 3 pertaining to the present embodiment. The liquid ejection head unit 3 includes line-type liquid ejection heads 10 in which 15 recording element substrates (liquid ejection heads 10) are arranged on a straight line (inline arrangement) and are each capable of ejecting four color inks of C/M/Y/K inks.

As shown in FIG. 9, the liquid ejection head unit 3 includes recording element substrates (liquid ejection heads 10), flexible wiring boards 40, and an electric wiring board 90. The electric wiring board 90 includes signal input terminals 91 and power supply terminals 92. These signal input terminals 91 and power supply terminals 92 are electrically connected to a controller of a recording apparatus 1000, and through these terminals, ejection driving signals or electric power required for ejection is supplied to the recording element substrates (liquid ejection heads 10).

The present embodiment is what is called a line head having a length corresponding to the width of a recording medium 2, but the present invention is also applicable to what is called a serial liquid ejection head 10 that performs recording while performing scanning on a recording medium 2. Examples of the serial liquid ejection head 10 include a head including a recording element substrate for a black ink and including recording element substrates for color inks.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-120417, filed Jun. 20, 2017, and Japanese Patent Application No. 2018-096200, filed May 18, 2018, which are hereby incorporated by reference herein in their entirety.

What is claimed is:

1. A liquid ejection head comprising:

a substrate including an electrically insulating film;

an energy generating element provided on the substrate and configured to generate energy used to eject a liquid;

a flow path formed through the substrate and communicating with an ejection port configured to eject the liquid; and a wiring layer formed in the electrically insulating film of the substrate and used to drive the energy generating element, the wiring layer being provided apart from a wall defining the flow path and provided to surround the flow path with respect to a plan view of the substrate.

2. The liquid ejection head according to claim 1, wherein the wiring layer is connected to a leak detection mechanism configured to detect a leak current flowing from the wiring layer.

3. The liquid ejection head according to claim 1, wherein the wiring layer is a power source wiring configured to supply a power source potential to the energy generating element.

4. The liquid ejection head according to claim 1, wherein the wiring layer is a power source wiring configured to supply a power source potential to a logic circuit that is configured to drive the energy generating element.

5. The liquid ejection head according to claim 1, further comprising an additional wiring layer that is formed in the electrically insulating film, apart from the wiring layer in a thickness direction of the substrate and is used to drive the energy generating element, the additional wiring layer being provided apart from the wall defining the flow path, wherein the wiring layer is provided more closely to the wall defining the flow path than the additional wiring layer.

6. The liquid ejection head according to claim 5, wherein the wiring layer is a power source wiring configured to supply a power source potential to the energy generating element.

7. The liquid ejection head according to claim 1, wherein two wiring layers are formed in the electrically insulating film, apart from each other in a thickness direction of the substrate.

8. The liquid ejection head according to claim 7, wherein one of the two wiring layers has a higher electric potential than the other of the two wiring layers.

9. The liquid ejection head according to claim 7, wherein an additional wiring layer is formed in the electrically insulating film, apart from the two wiring layers in a thickness direction of the substrate, is used to drive the energy generating element, and is provided apart from the wall defining the flow path, and the two wiring layers are provided more closely to the wall defining the flow path than the additional wiring layer.

10. The liquid ejection head according to claim 9, wherein one of the two wiring layers includes a power source wiring configured to supply a power source potential to the energy generating element, and the other of the two wiring layers includes a ground wiring configured to supply a reference potential to the energy generating element.

11. The liquid ejection head according to claim 10, wherein the additional wiring layer includes at least any of a logic signal wiring configured to transmit a signal to a logic circuit that is configured to drive the energy generating element, a power source wiring configured to supply a power source potential to the logic circuit, and a ground wiring configured to supply a reference potential to the logic circuit.

12. The liquid ejection head according to claim 9, wherein one of the two wiring layers includes a power source wiring configured to supply a power source potential to the energy generating element, and the other of the two wiring layers includes a ground wiring configured to supply a reference potential to a logic circuit that is configured to drive the energy generating element.

13. The liquid ejection head according to claim 9, wherein one of the two wiring layers includes a power source wiring configured to supply a power source potential to a logic circuit that is configured to drive the energy generating element, and the other of the two wiring layers includes a ground wiring configured to supply a reference potential to the logic circuit that is configured to drive the energy generating element.

14. The liquid ejection head according to claim 1, wherein an electric potential of 3.0 V or more is applied to the wiring layer.

15. The liquid ejection head according to claim 1, wherein a liquid supplied to the flow path is connected to a ground potential.

16. A liquid ejection apparatus comprising:

a liquid ejection head, the liquid ejection head including:

a substrate including an electrically insulating film, an energy generating element provided on the substrate and configured to generate energy used to eject a liquid, a flow path formed through the substrate and communicating with an ejection port configured to eject the liquid, and a wiring layer formed in the electrically insulating film of the substrate and used to drive the energy generating element, the wiring layer being provided apart from a wall defining the flow path and provided to surround the flow path with respect to a plan view of the substrate; and a leak detection mechanism electrically connected to the wiring layer and configured to detect a leak current flowing from the wiring layer.

17. The liquid ejection apparatus according to claim 16, wherein the wiring layer is a power source wiring configured to supply a power source potential to the energy generating element.

18. The liquid ejection apparatus according to claim 16, wherein two wiring layers are formed in the electrically insulating film, apart from each other in a thickness direction of the substrate.

19. The liquid ejection apparatus according to claim 18, further comprising an additional wiring layer that is formed in the electrically insulating film, apart from the two wiring layers in a thickness direction of the substrate, and is used to drive the energy generating element, the additional wiring layer being provided apart from the wall defining the flow path, wherein the two wiring layers are provided more closely to the wall defining the flow path than the additional wiring layer.

20. The liquid ejection apparatus according to claim 19, wherein one of the two wiring layers includes a power source wiring configured to supply a power source potential to the energy generating element, and the other of the two wiring layers includes a ground wiring configured to supply a reference potential to the energy generating element.

* * * * *